US007553259B2

(12) United States Patent
Landfair

(10) Patent No.: US 7,553,259 B2
(45) Date of Patent: Jun. 30, 2009

(54) MULTI-HANDLE WEIGHT EXERCISE DEVICE

(76) Inventor: Craig D. Landfair, 1142 Brunswick La., Ventura, CA (US) 93001

( * ) Notice: Subject to any disclaimer, the term of this patent is extended or adjusted under 35 U.S.C. 154(b) by 298 days.

(21) Appl. No.: 11/398,882

(22) Filed: Apr. 5, 2006

(65) Prior Publication Data

US 2007/0238578 A1 Oct. 11, 2007

(51) Int. Cl.
*A63B 21/06* (2006.01)

(52) U.S. Cl. ..... 482/49; 482/79; 482/80

(58) Field of Classification Search ..... 482/49, 482/141, 148, 23–35, 109, 106, 121, 126; D21/408, 398

See application file for complete search history.

(56) References Cited

U.S. PATENT DOCUMENTS

| | | | | | |
|---|---|---|---|---|---|
| 3,083,964 | A | * | 4/1963 | Wentzel | 482/34 |
| 4,673,179 | A | | 6/1987 | Pengler | |
| D299,373 | S | | 1/1989 | Parker et al. | |
| 4,854,573 | A | * | 8/1989 | Johannson et al. | 482/141 |
| D315,003 | S | | 2/1991 | Huang | |
| 4,995,604 | A | | 2/1991 | Lynch et al. | |
| 5,137,502 | A | | 8/1992 | Anastasi | |
| 5,413,548 | A | * | 5/1995 | Hoffman | 482/127 |
| 5,529,550 | A | * | 6/1996 | Maycock et al. | 482/44 |
| D382,610 | S | * | 8/1997 | Maycock et al. | D21/684 |
| 5,692,996 | A | | 12/1997 | Widerman | |
| 5,735,779 | A | | 4/1998 | Lay | |
| 6,068,580 | A | | 5/2000 | Myers et al. | |
| 6,319,176 | B1 | | 11/2001 | Landfair | |
| 6,436,015 | B1 | | 8/2002 | Frasco et al. | |
| D469,484 | S | | 1/2003 | Dawson | |
| D530,755 | S | * | 10/2006 | Wechsler | D21/398 |
| 2001/0049324 | A1 | | 12/2001 | Wallace et al. | |
| 2002/0022557 | A1 | | 2/2002 | Landfair | |

* cited by examiner

*Primary Examiner*—Jerome Donnelly
(74) *Attorney, Agent, or Firm*—J. Charles Dougherty

(57) ABSTRACT

An exercise device has a central grip with a first and second end. Three peripheral handles are symmetrically disposed around a central grip. Each peripheral handle has first and second radial portions extending from the first and second ends of the central grip, and a peripheral grip portion disposed between is respective radial portions. The peripheral grip portions are parallel to the central grip. The central grip has three partially flattened sides respectively facing each of the three peripheral grip portions. The junction of any two sides forms a curved edge that fits comfortably in the joint of a human finger. The peripheral distance around the central grip is two to three times the peripheral distance around a peripheral grip portion. In various exercises, users can grip a peripheral grip portion by one hand, use both hands to grasp adjacent peripheral grip portions, or grasp the central grip.

7 Claims, 3 Drawing Sheets

MULTI-HANDLE WEIGHT EXERCISE DEVICE

BACKGROUND OF THE INVENTION

1. Field of the Invention

The present invention relates to the mechanical arts. More specifically, the presentation invention relates to a free weight exercise device.

2. Description of the Related Art

As the world becomes increasingly health conscious, health clubs, including weight lifting facilities, grow increasingly common. With this growth, consumer demands have become increasingly sophisticated, requiring weight lifting devices that are more versatile, are more effective in isolating specific muscles or muscle groups, and are easier and safer to use. Although much attention has focused in past years on cable-type weight devices having variable resistance according to the shape of a cam, little work has gone into the advancement of free weight exercise devices.

U.S. Pat. No. D315,003 Huang discloses a free weight exercise device having three parallel tubular handles secured by opposing parallel triangular frames. U.S. Pat. No. D469,484 Dawson discloses a free weight exercise device formed from two tubular circles oriented on perpendicular planes and intersecting at two points, and a center tube extending from the first intersection to the second intersection. U.S. Pat. No. 4,673,179 Pengler is directed to a cube-shaped free weight. There are twelve lines at which the six surfaces of a cube intersect. These lines of intersection respectively form twelve handles, one handle along every line of intersection of two planes. An alternative embodiment includes a four-sided "pyramid structure" polygon, with handles formed by spaced openings at the intersection of two flat sides. The device may be variously hollow or solid.

There remains a need for a free-weight exercise device that can be used with one-handed exercises as well as two-handed exercises. There is further a need for a free-weight that will not roll when placed on the ground. There is further a need for a free weight that can rest in a stable orientation on the ground with a handle oriented along a vertical plane when the free-weight device is resting on the ground.

SUMMARY OF THE INVENTION

An exercise device has a central grip having a first end, a second end, and a longitudinal axis. A plurality of peripheral handles are disposed around the central grip. In some embodiments, the peripheral handles are identically sized and symmetrically disposed around the central grip. Each peripheral handle has a first radial portion extending outward from the first end of the central grip, a second radial portion extending outward from the second end of the radial grip, and a peripheral grip portion extending between respective first and second radial portions.

The central grip has a periphery at least ten percent greater than the periphery of a peripheral grip portion, and more preferably between two and three times as great as the periphery of a peripheral grip. The periphery of the central grip is preferably between 6 and 12 inches.

The plurality of peripheral handles preferably consists of an odd number of handles. In some embodiments, there are three peripheral handles and the central grip includes three sidewalls, with each sidewall facing a respective peripheral grip portion. In such embodiments, the peripheral handles have a substantially triangular cross section with curved corners that are sized to fit comfortably within a bent joint of a human finger.

DESCRIPTION OF THE PREFERRED EMBODIMENTS

Figure 1:
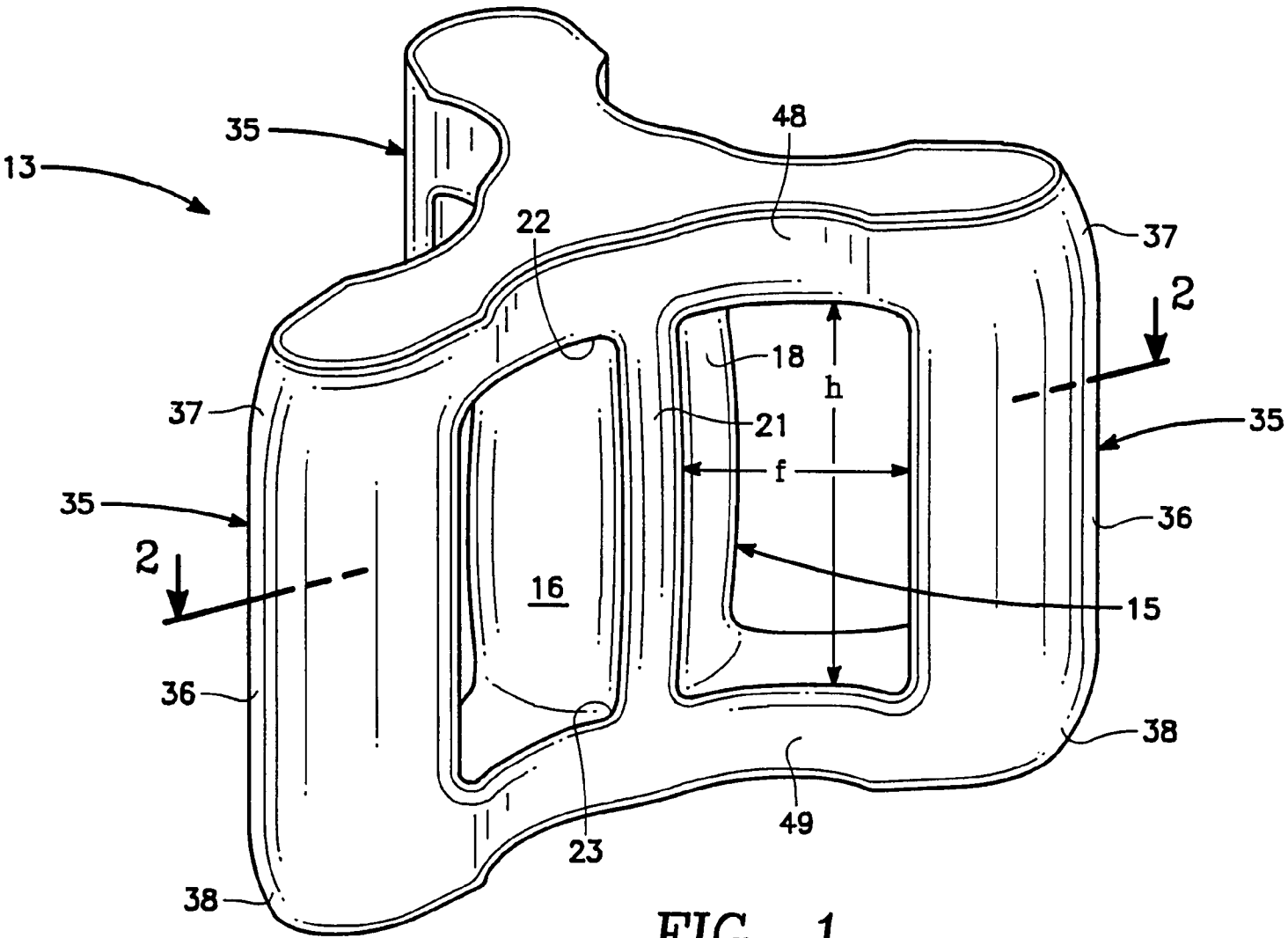
FIG. 1 is an isometric view of the exercise device of the claimed invention.
Figure 2:
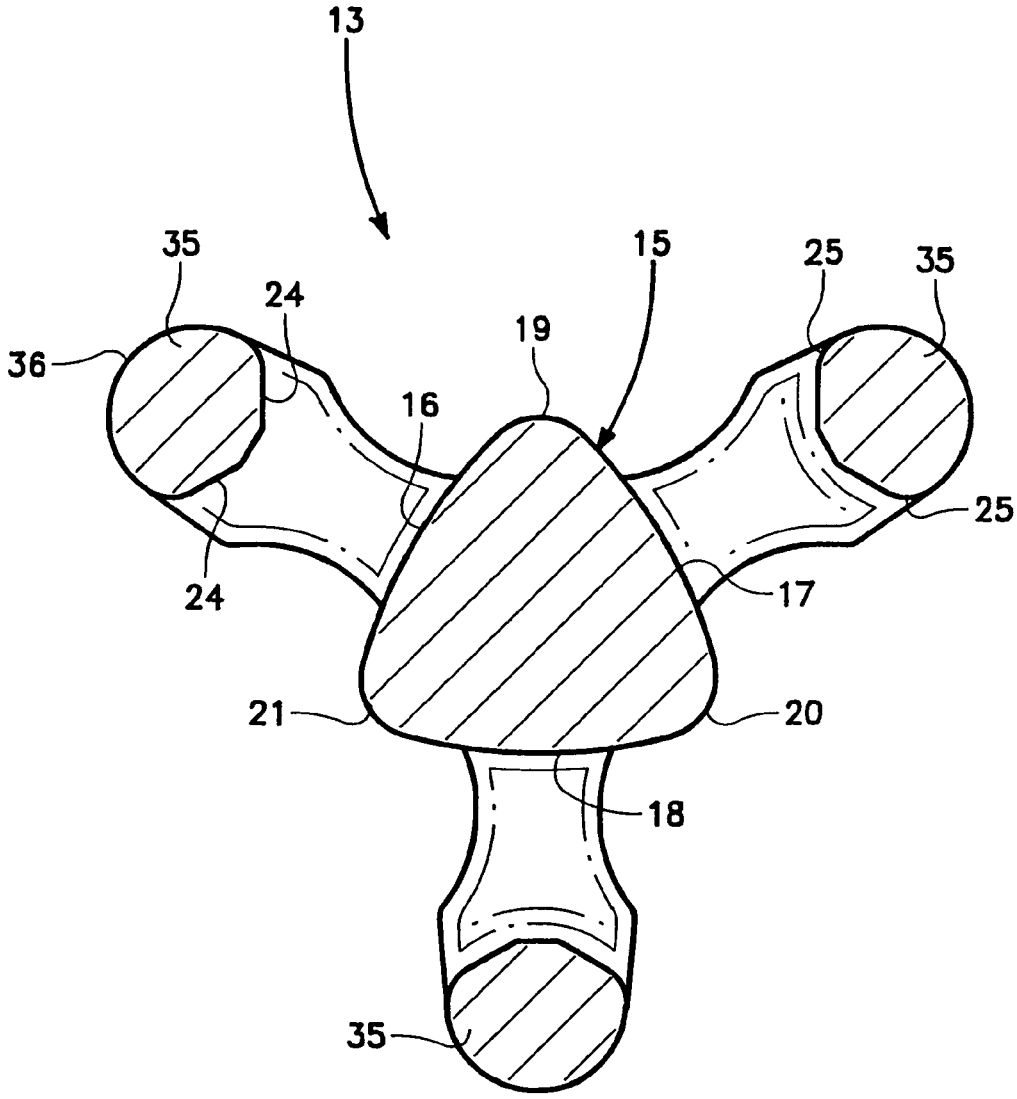
FIG. 2 is a cross sectional top plan view of the exercise device of FIG. 1.

FIGS. 1 and 2 generally disclose an exercise device 13 having a central grip 15 with a first end 22 and a second end 23 oriented along a longitudinal axis X. Three peripheral handles 35, preferably exhibiting uniform size and shape, are symmetrically oriented around the central grip, and attached thereto.

Figure 6:
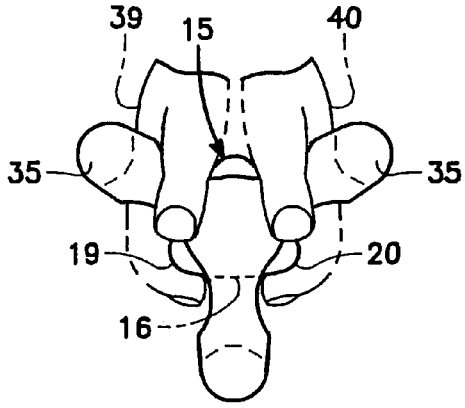
FIG. 6 illustrates an exercise where the device of FIG. 1 is lifted by a central grip.
Figure 7:
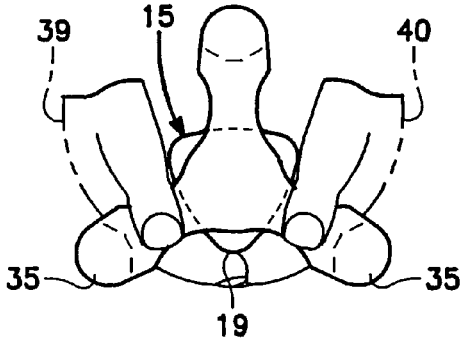
FIG. 7 illustrates an alternative exercise where the device of FIG. 1 is lifted by a central grip.

The central grip 15 has an essentially triangularly shaped cross section with three sidewalls 16-18 extending from the first end 22 of the central grip 15 to the second end 23 of the central grip. The sidewalls respectively abut at three edges 19-21, which also extend from the first end of the central grip to the second end of the central grip. The edges of the triangular central grip are curved to fit into the joints of a user's fingers as a user's hands wrap around the central grip, as illustrated in FIGS. 6 and 7. Although the preferred embodiment discloses a substantially triangular cross-section for the central grip, alternative cross-sections are envisioned within the scope of the invention, including other polygonal, elliptical and cylindrical cross-sections. Embodiments are envisioned wherein the central grip has a hollow center allowing weighted portions to be added or subtracted, thereby varying the weight of the exercise device.

The sidewalls 16-18 are bowed outward slightly, along the direction of the longitudinal axis X. The bowed sidewalls provide an ergonomically superior profile for securely grasping the central grip.

Each of the peripheral handles 35 has a peripheral grip portion 36, extending between pairs of radial portions comprising a first radial portion 48 and a second radial portion 49. In preferred embodiments, the peripheral handles extend radially outward from the longitudinal axis and are angularly spaced-apart about an equidistance. Preferably, the handles are symmetrically disposed about the central grip. Also in preferred embodiments, the peripheral grip portions are oriented parallel to the longitudinal axis of the central grip and the periphery of each of the peripheral grip portions is about the same size.

FIG. 2 shows a generally cylindrical cross section of the peripheral grip portion having two slightly flattened portions 24 on the surface nearest the associated sidewall 18. The flattened portions that an inner surface of a peripheral grip portion, resulting in a relatively abrupt curvature 25 opposing the sidewall, thereby enhancing the grip of a user.

Returning to FIG. 1, it can be seen that the first radial portion 48 extends from one end of its respective peripheral grip portion 36 to the first end 22 of the central grip 15, and the second radial portion 49 extends from the opposing end of its respective peripheral grip portion to the second end 23 of the central grip, thereby joining each peripheral grip portion 35 to the central grip.

The number of peripheral handles 35 is preferably an odd number so that, when two peripheral handles rest against the ground, a third peripheral handle will be aligned directly above the central grip 15. This allows an even distribution of weight when the exercise device 13 is raised by the third handle. According to a preferred embodiment, the exercise device will have three peripheral handles evenly spaced around the central grip. However, the depiction of a three handled device within the attached figures is not intended to preclude other embodiments consistent with the appended claims, including, but not limited to embodiments having four, five, or other numbers of peripheral handles.

The description of distinguishable portions throughout this description is not intended to limit the manufacture of the invention. The central grip 15 and peripheral handles 35 may be integrally formed from single piece construction, or may be formed by securely joining multiple independent portions.

The exercise device 13 or portions thereof can be coated with rubber, plastic, or some other coating. Depending on the texture and placement, a coating can variously serve to damp impact sounds and prevent the exercise device from scratching or damaging other furniture or work-out stations. The central grip 15 and peripheral grip portions 36 can also be coated with a coating that enhances a user's grasp. Surface textures such as knurling can be used in conjunction with, or in place of surface coating to enhance the user's grasp.

Different users have differently sized hands that will be advantageously served by differently sized exercise devices. Accordingly, the present invention envisions exercises devices 13 having similar shape, but having a variety of weights and sizes thereby enhancing the usability among diverse users.

A variety of weights are envisioned according to the size and strength of a user. Typically, the weight of exercise device of the claimed invention will be within the range of 3 to 50 pounds, with most users using the claimed exercise device in the 3 to 30 pound range.

As can be appreciated by FIGS. 3-7, a user's hand should be able to wrap around a peripheral grip portion 36 and at least partly around the central grip 15. Referring to FIG. 1, the finger distance "f" between a peripheral grip portion 36 and the central sidewall 18 facing the respective peripheral grip portion must be great enough to allow a user's fingers to be comfortably inserted. Although this distance will vary according to finger size, most common hand sizes will be accommodated by a finger distance "f" of between about 1 and 2 inches.

The hand height "h" separating the first radial portion 48 and second radial portion 49 of a handle must be large enough for a user to insert a hand comfortably. Although different sizes can be manufactured to accommodate varying hand sizes, for most hands, this distance will preferably be in the range of 3 to 6 inches, and even more preferably, in the range of 3.5 to 4.5 inches.

Figure 3:
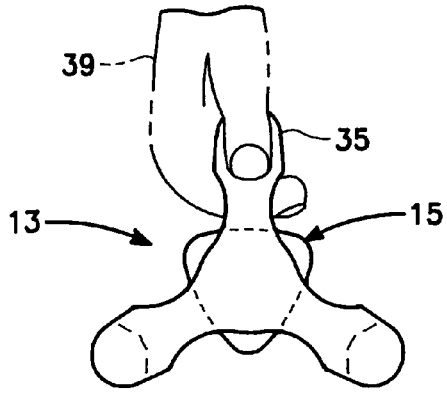
FIG. 3 illustrates an exercise where the device of FIG. 1 is lifted by a single peripheral handle positioned toward the user.
Figure 4:
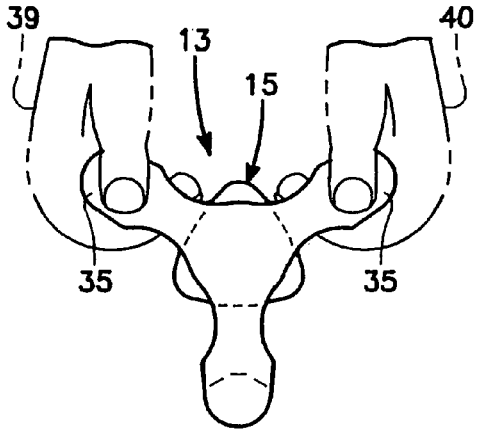
FIG. 4 illustrates an exercise where the device of FIG. 1 is lifted by two peripheral handles positioned toward the user.
Figure 5:
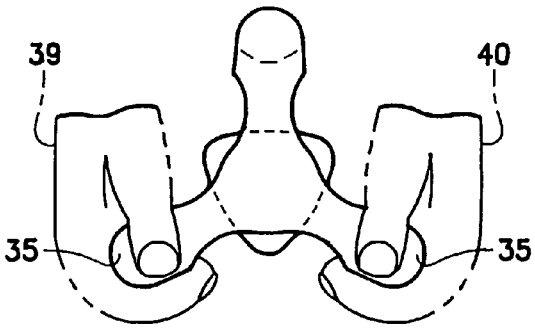
FIG. 5 illustrates an exercise where the exercise device of FIG. 1 is lifted by two peripheral handles positioned away from user.

It is an advantage of the invention, that the central grip 15 can be used in conjunction with a two handed grasp as shown in the exercise methods disclosed in FIGS. 6 and 7, while the peripheral grip portions are used in conjunction with a single handed grasp, as shown in FIGS. 3-5. In order to accommodate two hands, the central grip 15 will preferably have an outer periphery that is at least ten percent greater than the outer periphery of a peripheral grip portion 36. Even more preferably, the outer periphery of the central grip will be in the range of two to three times as great as the circumference of a peripheral grip portion 36.

Accordingly, measured at its widest point, the periphery of the central grip 15 will typically range between 6 and 12 inches preferably from about 9 to about 11 inches, to accommodate most two-handed users. However, the present invention fully anticipates small-handed users performing one-handed exercises grasping the center grip, as well as users with abnormally large or small hands performing two handed exercises using the center grip. Accordingly, a periphery of the central grip 15 greater than 5 or less than 15 inches is envisioned within the scope of the appended claims.

FIG. 3 shows a right hand 39 of a user gripping a single peripheral grip portion 36 of the exercise device 13. The exercise device can be used in this manner for the same range of exercised that can be performed by a conventional dumbbell. It is understood that the use of the right hand is exemplary, and that an identical range of exercises can be performed by the left hand of a user.

FIGS. 4 and 5 show a user grasping two peripheral grip portions 36 with respective left and right hands 39, 40. In FIG. 4, the unused peripheral grip portion is directed away from the user's body, and in FIG. 5, the unused grip is directed toward the user's body.

FIG. 6 shows a user grasping the central grip 15 with left and right hands 39, 40. The distal joints 41 of the left hand fingers are curled over curved edge 20, and the distal joints of the right hand finger are curled over curved edge 19, while the thumbs are curled over the first radial portions. The distal phalanges of both hands rest against the lower sidewall 16.

FIG. 7 shows a user grasping the central grip 15 with an alternative two-handed hold. The curved edge 19 is pointing downward, and distal joints of both left and right hand fingers are curled under the same curved edge 19, thereby securing and supporting the exercise device 13 as the user moves the device through a range of motions. In this gripping position, fingers may be interlocked or overlapped according to individual preference and comfort.

Single handed exercises can include, but are not limited to forearm curls and overhead extensions for exercising the triceps. As discussed above, embodiments of the claimed invention include center grip 15 sized for single-handed exercises. Two handed grasping techniques can be used in conjunction with, but are not limited to, bent rowing for strengthening back muscles, triceps extensions, and various sideways motions for developing the external and internal obliques, and the transverse abdominis muscles in the trunk. By having a central grip with a different peripheral measure than the peripheral grip portions 36, the curvature of the fingers and hand around the central grip 15 will be different than the curvature of the fingers and hand around a peripheral grip portion 36. By alternating between the various grips 15, 36, the range of physical demands placed on the muscles of the hand and forearm during a work-out can be broadened, including the palmaris brevis and palmar interosseous of the hand, as well as the various flexor muscles that extend from the forearm to the tips of the thumb and fingers.

Within the foregoing description, many specific details commonly understood by those skilled in the art have not been recited so as to not needlessly obscure many of the essential features of the present invention. In other instances, some non-essential details of the present invention have been recited in the detailed description to better enable the reader to make and use the claimed invention, and should not be interpreted as limiting the scope of the claims appended hereto. It will be understood that the appended claims are intended to cover alternative structures, processes, modifications, and equivalents which may be included within the spirit and scope of the foregoing description in view of the appended claims.

I claim:

1. An exercise device comprising:

a) a central grip having a longitudinal axis and b) a plurality of peripheral handles consisting of an odd number of handles, each peripheral handle having a peripheral grip portion extending between pairs of first and second radial portions, said first and second radial portions extending outward from said central grip, said central grip having a periphery at least ten percent greater than the periphery of at least one of the peripheral grip portions, and wherein the central grip has an outer surface comprising a plurality of curved sidewalls, each sidewall facing a respective peripheral grip portion.

2. The exercise device of claim 1 wherein the peripheral grip portions are parallel to the central grip.

3. The exercise device of claim 1 wherein the peripheral handles are symmetrically disposed about the central grip.

4. The exercise device of claim 1 wherein the plurality of handles comprises three handles.

5. The exercise device of claim 1 wherein the outer surface further comprises a plurality of curved edges each curved edge separating adjacent sidewalls.

6. The exercise device of claim 1 wherein the perimeter of the central grip is between 6 inches and 12 inches.

7. The exercise device of claim 1 wherein each pair of first and second radial portions extend radially outward from said longitudinal axis and are angularly spaced-apart about an equidistance.

* * * * *